United States Patent [19]

Seko et al.

[11] Patent Number: 4,583,834

[45] Date of Patent: Apr. 22, 1986

[54] COPYING APPARATUS

[75] Inventors: Nachio Seko; Tatsuo Tani; Hiroyuki Idenawa; Takashi Yano; Isao Nakamura, all of Tokyo, Japan

[73] Assignee: Ricoh Company, Ltd., Tokyo, Japan

[21] Appl. No.: 940,857

[22] Filed: Sep. 8, 1978

[30] Foreign Application Priority Data

Sep. 16, 1977 [JP] Japan ..... 52-111382
Oct. 6, 1977 [JP] Japan ..... 52-120349

[51] Int. Cl.[4] ..... G03G 15/00
[52] U.S. Cl. ..... 355/14 C; 355/14 R
[58] Field of Search ..... 355/14 R, 3 R, 14 C; 364/900, 107

[56] References Cited

U.S. PATENT DOCUMENTS 4,071,911 1/1978 Mazur ..... 364/107 X
4,124,887 11/1978 Johnson ..... 364/107
4,144,550 3/1979 Donohue et al. ..... 355/14 X

*Primary Examiner*—R. L. Moses
*Attorney, Agent, or Firm*—David G. Alexander

[57] ABSTRACT

A plurality of copying machines (12), (13), (14) are connected to a computer (39). Each copying machine (12), (13), (14) comprises sensor means (16), (17), (18), (19), (21), (22), (23), (24) for sensing various operating parameters thereof such as a total number of copies produced, machine malfunctions, amounts of remaining copy sheets and toner, etc. These parameters are all transmitted to the computer (39) which processes and prints them out. In response to a copying machine malfunction the computer (39) feeds back to the malfunctioning copying machine instructions for correction. The instructions are displayed at the copying machine. The computer (39) further computes the degree of degeneration of the photoconductive element of each copying machine (12), (13), (14) and controls the imaging exposure intensity and developing bias voltage in accordance therewith.

9 Claims, 3 Drawing Figures

COPYING APPARATUS

BACKGROUND OF THE INVENTION

The present invention relates to an electrostatic copying apparatus comprising a plurality of copying machines connected to a computer.

Conventional copying machines are self contained units each being provided with copy counters, jam detectors and indicators, etc. In large business and government offices which use a number of copying machines, it is desirable for cost allocation purposes to determine not only the total number of copies produced by all of the copying machines but the number of copies produced by each section or division of the office. The problem is compounded if two or more sections each have access to two or more copying machines.

The arrangement used heretofore has been a key counter system. Each copying machine is provided with a key counter for each user or section. The copying machine is energized by inserting the key into the corresponding key counter, which counts the number of copies produced. For billing or cost allocation, personnel must go to all of the copying machines, record the total number of copies produced and also the number of copies indicated by each key counter. The total number of copies produced by all of the copying machines is determined by adding the totals for the individual copying machines. The number of copies per section or user is determined by adding the number of copies indicated by the respective key counters in all of the copying machines.

This procedure is very time consuming and prone to error. In a large organization having many sections, each having access to many copying machines, a key counter for each section must be provided to each copying machine. Such a large number of key counters necessitates excessive purchase cost and installation space. In addition the mechanical key counters are prone to frequent malfunction.

It is also desirable to replenish copy sheets, toner, etc. in each copying machine so that it will not run out of such supplies during use. Frequent inspection of each copying machine on an individual basis, as has been heretofore necessary in the art, is very time consuming.

It is also desirable to compensate the imaging exposure intensity and developing bias voltage as a function of the degree of degeneration of a photoconductive drum or the like. Prior to the present invention, it has been necessary to provide such means to each copying machine, increasing the cost and complexity thereof.

In case of malfunction of a copying machine, it has been heretofore necessary for the operator to diagnose the problem by referring to service manuals. If the malfunction cannot be corrected by the operator, he must call maintenance personnel. Such a process is time consuming and inefficient and results in unnecessarily excessive down time of the copying machine.

SUMMARY OF THE INVENTION

A copying apparatus embodying the present invention includes a plurality of copying machines, each having sensor means for sensing operating parameters thereof. Storage means are provided in each copying machine for storing the parameters. The parameters are periodically transmitted to a computer which processes and displays the parameters.

It is an object of the present invention to provide a copying apparatus comprising means for automatically sensing and processing operating parameters of a plurality of copying machines.

It is another object of the present invention to provide a copying apparatus comprising means for controlling a plurality of copying machines in response to sensed parameters.

It is another object of the present invention to provide a copying apparatus comprising means for sensing malfunctions in a plurality of copying machines, computing instructions for correcting the malfunction and feeding the same to the malfunctioning copying machine which displays the instructions for the benefit of a copying machine operator.

It is another object of the present invention to provide a generally improved copying apparatus.

Other objects, together with the following, are attained in the embodiment described in the following description and shown in the accompanying drawing.

DESCRIPTION OF THE PREFERRED EMBODIMENT

While the copying apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
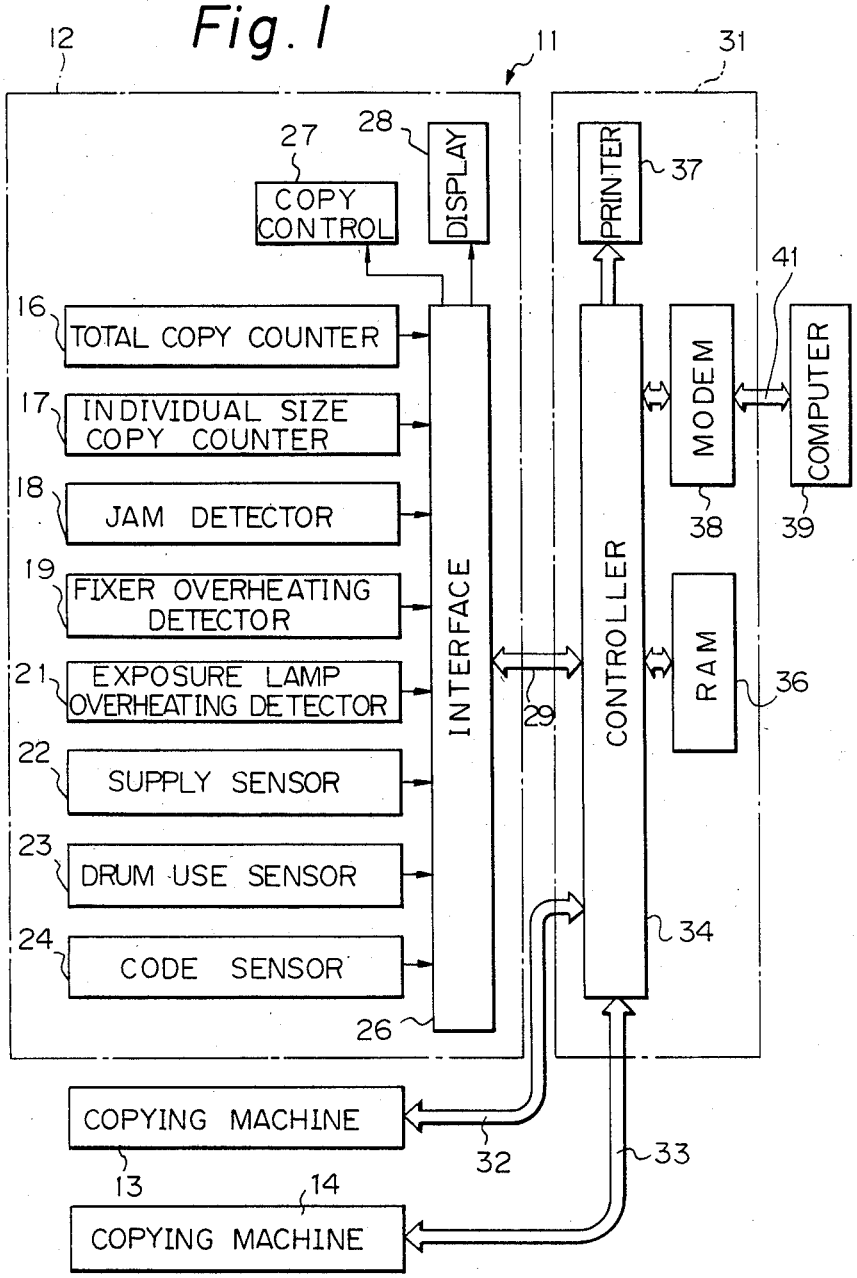
FIG. 1 is a block diagram of a copying apparatus embodying the present invention.

Referring now to FIG. 1 of the drawing, a copying apparatus embodying the present invention is generally designated as 11 and comprises a plurality of electrostatic copying machines, here illustarted for exemplary purposes as being three in number and designated as 12, 13 and 14 respectively. The copying machines 12, 13 and 14 may or may not be identical, but each comprises the elements which will be described hereinbelow.

Taking the copying machine 12 by way of example, it will be seen that the copying machine 12 comprises a plurality of sensors 16, 17, 18, 19, 21, 22, 23 and 24 for sensing various operating parameters thereof. The sensor 16 counts the total number of copies produced by the copying machine 12. The sensor 17 comprises a plurality of counters for counting the numbers of copies produced of respective different sizes. For example, the sensor 17 may comprise two counters for counting the numbers of A4 and B4 copies produced respectively.

The sensor 18 functions to detect paper jams in the copying machine 12. Although not illustrated in detail, the sensor 18 may comprise switches or the like to sense for malfunctions in sheet feed from a cassette, separation from a photoconductive drum after toner image transfer and discharge into a receiving tray after fixing of the toner image.

The sensor 19 senses for an overheating condition of a heater in a fixing unit (not shown).

The sensor 21 senses for an overheating condition of an exposure lamp (not shown) as indicated by continuous glowing, sparking, etc.

The sensor 22 senses the remaining number of supplies such as copy sheets, toner, etc. The number of remaining sheets may be determined by counting the number of copies produced of the respective sheet size after placing a new stack of sheets in a cassette and subtracting this number from the number of sheets in the stack. The amount of remaining toner is similarly indicated by the total number of copies produced after adding a new container of toner.

The sensor 23 senses the amount of use of the photoconductive element or drum (not shown). The counter 23 is reset when a new drum is installed in the copying machine 12 and counts the number of copies produced after the installation.

The sensor 24 typically comprises a magnetic or photoelectric card reader, although not shown in detail. Each user of the copying machine 12 is provided with a card bearing a code identifying the user. To use the copying machine 12, the user inserts the card into the reader. If the user is authorized to use the copying machine, the same will be energized. The sensor 24 generates codes identifying the copying machine 12 and the user.

The outputs of the sensors 16, 17, 18, 19, 21, 22, 23 and 24 are connected to an interface 26. Further connected to the interface 26 are a copy control unit 27 and a display 28 such as a CRT or LED unit as will be further described below.

The interface 26 is connected through a transmission link 29 to a processor 31. The copying machines 13 and 14 are also connected to the processor 31 through transmission links 32 and 33 respectively.

The processor 31 comprises a controller 34 which includes a non-volatile random access memory (RAM) 36 and a display means such as a printer 37. The processor 31 further comprises a modem 38 which connects the processor 31 to a computer 39 via a transmission link 41 such as a public telephone network.

The interface 26 comprises a storage means (random access memory) which will be described in detail later with reference to FIG. 2. However, it is sufficient at the present stage of description to understand that the storage means of the interface 26 functions to store the outputs of the sensors 16, 17, 18, 19, 21, 22, 23 and 24. These parameters are transmitted to the processor 31 at periodic intervals. The parameters of the copying machines 12, 13 and 14 are transmitted sequentially to the processor 31. In other words, all of the parameters of the copying machine 12 are transmitted to the processor 31 which processes the parameters as will be described below. Then, the parameters of the copying machine 13 are transmitted to the processor 31 and processed. Subsequently, the parameters of the copying machine 14 are transmitted to the processor 31 and processed.

The controller 34 stores the parameters in the RAM 36 and feeds them to the computer 39 as required. In addition, the parameters are printed out by the printer 37.

The total number of copies produced by all of the copying machines 12, 13 and 14 is computed either by the controller 34 or the computer 39 and printed by the printer 37. The numbers of copies made of each size and by each user are similarly computed and printed. The user is identified by the code from the sensor 24. The user code indicates that the number of copies produced is to be added to the previous total for the user stored in a particular memory location in the RAM 36.

The amounts of copy sheets and toner remaining in each of the copying machines 12, 13 and 14 are computed in the manner indicated above. Either the computer 39 or controller 34 is provided with means for producing a printed indication by the printer 37 when sheets or toner should be replenished. This allows replenishment at an optimum time so that frequent inspection of the copying machines is unnecessary but the copying machines will not run out of copy sheets or toner during use.

Whenever a malfunction is detected by the sensors 18, 19 or 21, the computer 39 interrupts the normal sequential transmission of the parameters and senses the parameters of the malfunctioning copying machine on a priority basis. Depending on which of the sensors 17, 18 and 19 produces a malfunction indication, the computer 39, utilizing a prearranged program, computes instructions for correcting the malfunction and feeds the instructions to the malfunctioning copying machine. The interface 26 controls the display 28 to display the instructions. This allows the operator to correct the malfunction immediately and efficiently merely by following the instructions displayed by the display 28. In case of a serious malfunction, however, the instructions may be adapted to instruct the operator to call service personnel rather than attempt correction himself.

It is well known by all of those skilled in the art that a photoconductive element such as a drum tends to degenerate with prolonged use. To obtain optimum copies, it is necessary to adjust the imaging exposure intensity and the developing bias voltage in accordance with the degree of degeneration. The sensor 23 counts the number of copies made since the drum was installed and thereby indicates the amount of use of the drum. The controller 34 or computer 39 computes the degree of degeneration of the drum based on the amount of use and feeds signals to the interface 26 indicating the correct amount of compensation of the imaging light intensity and developing bias voltage.

The copy control unit 27 is controlled by the interface 26 to control the operating sequence and parameters of the copying machine 12. Inputs to the copy control unit 27 include a sheet size indication, a jam indication, a sheet discharge indication and a train of timing pulses. Outputs of the copy control unit 27 are typically fed to control a drum drive motor, a corona charger, an imaging exposure lamp, a developing bias voltage source, a corona transfer charger, a corona sheet separation charger, forward and reverse clutches of a platen carriage drive system and a sheet feed clutch, although these elements are not the particular subject matter of the present invention and are not shown.

Figure 2:
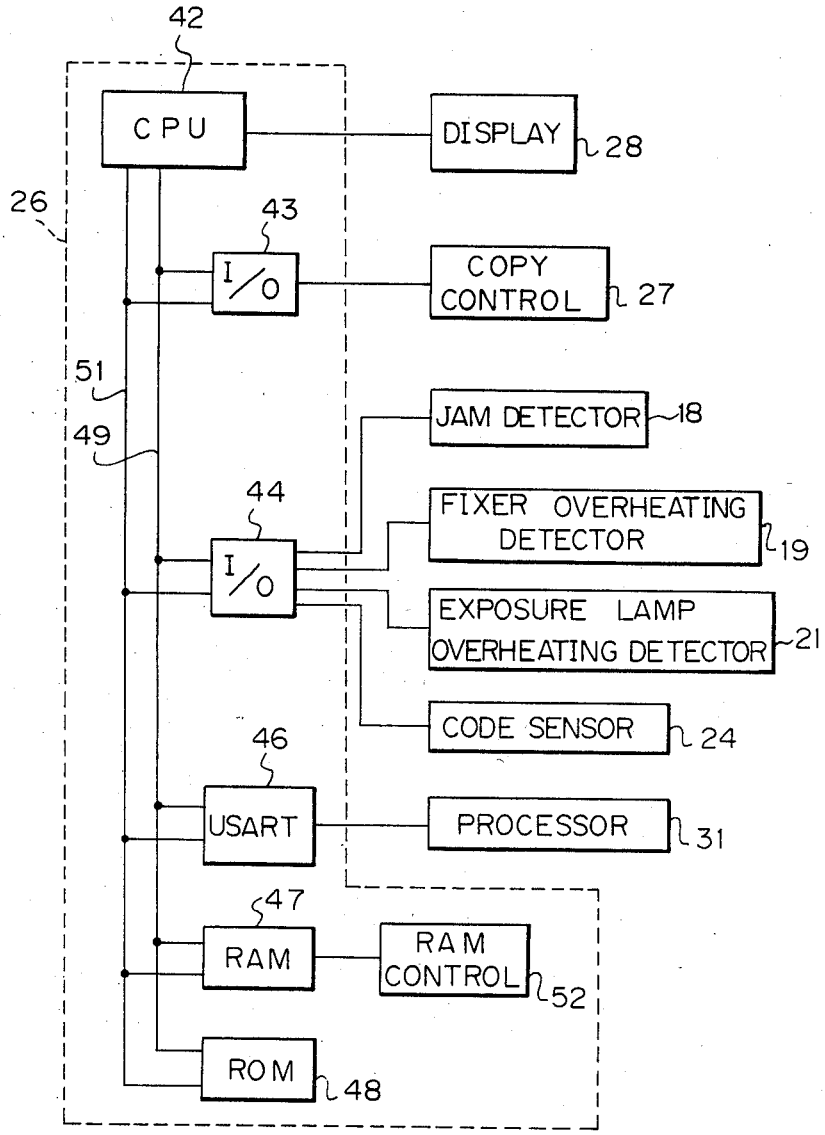
FIG. 2 is a block diagram of an interface of the present apparatus.

The interface 26 and associated components are illustrated in FIG. 2. The interface 26 comprises a central processing unit (CPU) 42 which is typically in the form of an integrated circuit chip such as the INTEL 8048. The CPU 42 is connected to input-output interfaces (I/O) 43 and 44, a universal synchronous/asynchronous receiver/transmitter (USART) 46, a random access memory (RAM) 47 and a read-only memory (ROM) 48 through an address bus 49 and a data bus 51. The RAM 47, like the RAM 36, is of the non-volatile type and holds data therein even when the power is shut off. A RAM control unit 52 is shown for the RAM 47. The operating program for the interface 26 is stored in the ROM 48.

The interface 43 is connected to the copy control unit 27. The interface 44 is connected to the sensors 18, 19,

21 and 24. The USART 46 is connected to the processor 31. In addition, the CPU 42 is connected to the display 28.

Outputs of the sensors 16, 17, 22 and 23 are stored in the RAM 47. More specifically, the parameter sensed by each of said sensors is assigned a particular memory location (or locations) in the RAM 47. The numbers stored in the locations are read into the CPU 42, incremented and written again into the same memory location in the RAM 47 as required.

Figure 3:
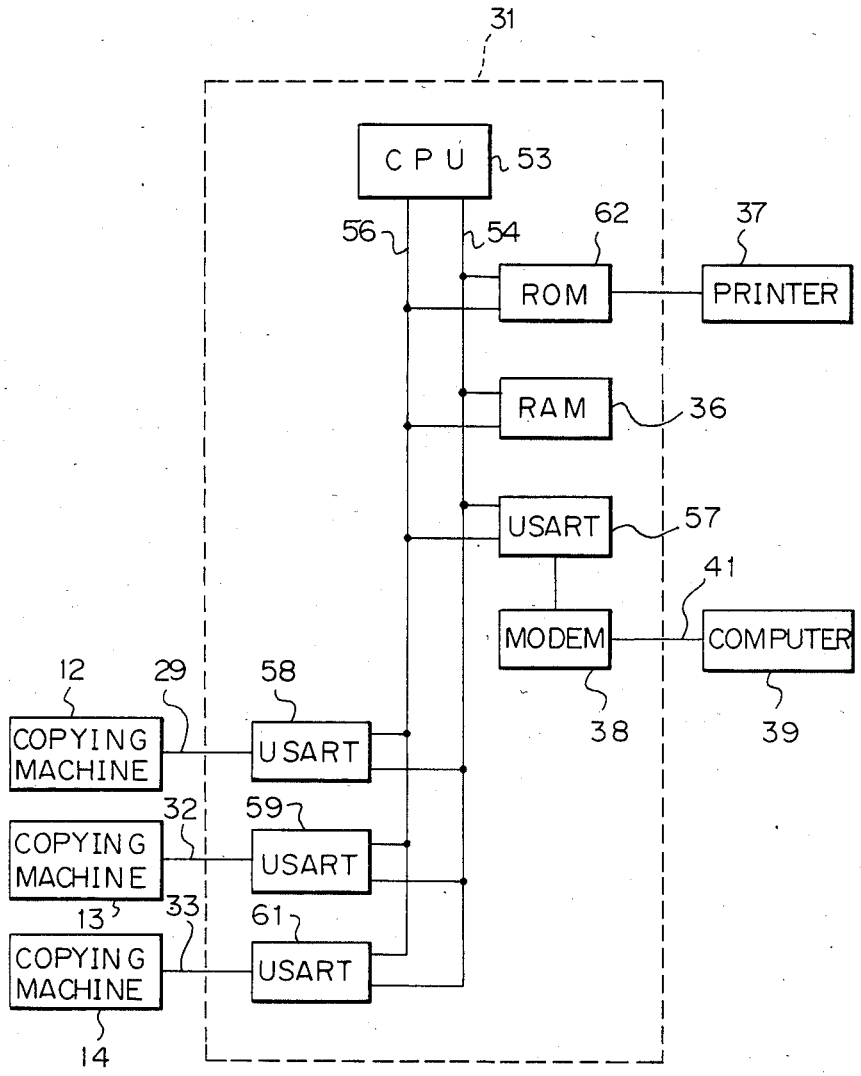
FIG. 3 is a block diagram of a processor of the present apparatus.

The processor 31 is shown in FIG. 3 as comprising a CPU 53 which is connected through an address bus 54 and a data bus 56 to the RAM 36, a USART 57, a USART 58, a USART 59, a USART 61 and a ROM 62. The USARTs 58, 59 and 61 are connected to the copying machines 12, 13 and 14 respectively. The USART 57 is connected to the modem 38. The ROM 62 is connected to the printer 37.

The operating program for the processor 31 is stored in the ROM 62 which controls the operation of the CPU 53 under the overall control of the computer 39. The parameters and intermediate values are stored in the RAM 36.

In summary, it will be appreciated that the present invention provides a copying apparatus which enables optimal control of a plurality of copying machines and indication of operating parameters thereof in an automatic manner using a single computer. Various modifications will become possible for those skilled in the art after receiving the teachings of the present invention without departing from the scope thereof. For example, although only one processor 31 is illustrated, a number of processors 31 each connected to a plurality of different copying machines may be connected to the computer 39. Where only one processor 31 is provided, it may be located either near the computer 39 or in a remote location near the copying machines 12, 13 and 14. In case of a larger system in which copying machines in several different offices are controlled by a single computer 39, a processor 31 will be located in each office and connected to the computer 39 by a telephone link or the like. Also, the printer 37 may print an indication when the drum of any of the copying machines 12, 13 and 14 has degenerated to such an extent that it should be replaced.

What is claimed is:

1. A copying apparatus including a plurality of copying machines each having sensor means for sensing operating parameters thereof, characterized by comprising:

storage means provided in each copying machine respectively for storing the parameters thereof;

computing means; and transmission means for transmitting the parameters from the storage means of all of the copying machines to the computing means;

the computing means comprising display means for displaying the parameters of all of the copying machines and being constructed to operate on the parameters in a predetermined manner.

2. An apparatus as in claim 1, in which the transmission means is constructed to transmit the parameters of the copying machines to the computing means in sequence.

3. An apparatus as in claim 1, in which the display means comprises a printer.

4. A copying apparatus including a plurality of copying machines each having sensor means for sensing operating parameters thereof, characterized by comprising:

storage means provided in each copying machine respectively for storing the parameters thereof;

computing means for operating on the parameters in a predetermined manner; and transmission means for transmitting the parameters from the storage means of all of the copying machines to the computing means;

the parameters including at least two of the following parameters: a total number of copies, numbers of copies of different sizes, a sheet jam, a fixer overheating condition, an exposure lamp overheating condition, a number of remaining copy sheets, an amount of remaining toner, an amount of photoconductive element use and an identification code.

5. A copying apparatus including a plurality of copying machines each having sensor means for sensing operating parameters thereof, characterized by comprising:

storage means provided in each copying machine respectively for storing the parameters thereof;

computing means; and transmission means for transmitting the parameters from the storage means of all of the copying machines to the computing means;

the parameters including malfunction conditions of the copying machines, the computing means being constructed to compute and feed to a malfunctioning copying machine instructions for correcting the malfunction, each copying machine comprising display means for displaying the instructions.

6. A copy apparatus including a plurality of copying machines each having sensor means for sensing operating parameters thereof, charactrized by comprising:

storage means provided in each copying machine respectively for storing the parameters thereof;

computing means; and transmission means for transmitting the parameters from the storage means of all of the copying machines to the computing means;

the parameters comprising an amount of photoconductive elements use, the computing means being constructed to compute a degree of photoconductive element degeneration and control the copying machines in response thereto.

7. An apparatus as in claim 6, in which each copying machine comprises means for controlling at least one of an imaging exposure intensity and a developing bias voltage in response to the computed degree of photoconductive element degeneration.

8. A copying apparatus including a plurality of copying machines each having sensor means for sensing operating parameters thereof, characterized by comprising:

storage means provided in each copying machine respectively for storing the parameters thereof;

computing means for operating on the parameters in a predetermined manner; and transmission means for transmitting the parameters for the storage means of all of the copying machines to the computing means;

the computing means comprising a computer and processing means for processing the parameters prior to feeding the parameters to the computer.

9. An apparatus as in claim 8, in which the processing means comprises a central processing unit, a read-only memory containing an operating program and a random-access memory for temporarily storing the parameters.

* * * * *